US005742013A

United States Patent [19]

Myojin et al.

[11] Patent Number: 5,742,013

[45] Date of Patent: Apr. 21, 1998

[54] TWO-WAY LEVER SWITCH

[75] Inventors: Satoshi Myojin, Tokyo; Shuji Tanaka, Kanagawa-ken, both of Japan

[73] Assignee: Mutsuki Denshi Kogyo Kabushiki Kaisha, Tokyo, Japan

[21] Appl. No.: 653,497

[22] Filed: May 24, 1996

[30] Foreign Application Priority Data

May 26, 1995 [JP] Japan ..... 7-152695

[51] Int. Cl.[6] ..... H01H 3/12; H01H 15/02; H01H 9/16

[52] U.S. Cl. ..... 200/6 R; 200/563; 200/315

[58] Field of Search ..... 200/5 A, 5 R, 200/6 R, 61.54, 61.27, 76, 284, 339, 547, 315

[56] References Cited

U.S. PATENT DOCUMENTS 4,281,232 7/1981 Hirai et al. ..... 200/315
5,099,095 3/1992 Takano ..... 200/563

*Primary Examiner*—Peter S. Wong
*Assistant Examiner*—Rajnikant B. Patel
*Attorney, Agent, or Firm*—Knobbe, Martens, Olson & Bear, LLP

[57] ABSTRACT

A two-way lever switch capable of being highly readily and rapidly assembled with high accuracy, exhibiting satisfactory durability, and reducing a manufacturing cost thereof. The two-way lever switch includes three component or a spring-equipped lever in which a U-shaped spring is fitted in a lever member, an upper casing in which the spring-equipped lever is mounted, and a lower casing in which the upper casing is fitted; wherein the three components are assembled together in turn without using any fasteners such as screws or the like.

6 Claims, 6 Drawing Sheets

S
1
2
3
4
9
13,a'
13,b'
15
17,14
19
22
24

S
1
2
15,17
16
18
20
23
24

S
1
2
13,a'
13,b'
16
18,24
20
22
23
28

S
13,a'
13,b'
15
17
18
22
23
24

S
1
9
14
15
17
22
23
24,18
24

TWO-WAY LEVER SWITCH

BACKGROUND OF THE INVENTION

This invention relates to a two-way lever switch, and more particularly to a two-way lever switch which is so constructed that application of external force to a spring-equipped lever member of the lever in either right or left direction causes the lever member to be pivotally moved by a predetermined angle about pivot shaft in the right or left direction, resulting in one of right and left contacts defined at both distal ends of a U-shaped spring element and kept pressedly contacted with both lateral fixed contacts being separated from corresponding one of the fixed contacts, leading to switching-off operation.

Recently, a demand has been highly increased for a switch which is adapted to equally or uniformly carry out switching operation by means of external force applied thereto in one of two directions or either right or left direction.

In view of the fact, the assignee proposed a two-way switch constructed so as to meet the demand, as disclosed in Japanese Patent Application Laid-Open Publication No. 14471/1995.

The two-way switch proposed is a fundamental two-way switch including a U-shaped spring element. Practical use of the switch reveals that it exhibits disadvantages or problems in use and during manufacturing.

SUMMARY OF THE INVENTION

The present invention has been made in view of the foregoing disadvantage of the prior art.

Accordingly, it is an object of the present invention to provide a two-way lever switch which is capable of being highly readily and rapidly assembled.

It is another object of the present invention to provide a two-way lever switch which is capable of being constructed with high accuracy.

It is a further object of the present invention to provide a two-way lever switch which is capable of exhibiting satisfactory durability.

It is still another object of the present invention to provide a two-way lever switch which is capable of reducing a manufacturing cost thereof.

In accordance with the present invention, a two-way lever switch is provided. The two-way lever switch includes a spring-equipped lever including a lever member and a U-shaped spring. The lever member is formed at a rear end thereof with a pivot shaft inserting hole. Also, the lever member is formed at the rear end thereof with a recess in a manner to be arranged about the pivot pin inserting hole. The U-shaped spring has contacts defined at both distal ends thereof and is fitted in the recess of the lever member while rearwardly projecting the contacts from the recess of the lever member. The two-way lever switch also includes an upper casing including a top plate and divided into a front section and a lower section. The front section includes a front portion of the top plate which is provided at a center of a lower surface thereof with a pivot shaft. The rear section includes a rear portion of the top plate and is formed therein with fixed contacts. The fixed contacts each include a vertical portion arranged on each of lateral side surfaces of the rear section of the top plate and a horizontal portion arranged on each of both sides of a lower surface of the rear portion of the top plate so as to be contiguous to the vertical portion and have a terminal defined at a distal end thereof so as to rearwardly outwardly project from the top plate.

Further, the two-way lever switch includes a lower casing including a bottom plate and lateral side plates. The bottom plate is provided on an upper surface thereof with a fit recess which is formed into a shape conforming to an outer configuration of the upper casing. The lateral side plates each are formed on an outer surface thereof with a pawl-equipped spring element for mounting the lever switch. The bottom plate is provided on a lower surface thereof with positioning projections. The pivot shaft of the upper casing is inserted into the pivot shaft inserting hole of the spring-equipped lever, to thereby cause the lever member to be forwardly projected at a distal end thereof from the opening of the upper casing, resulting in the lever member being pivotally moved within a range defined by the opening and each of the contacts of the U-shaped spring being pressedly contacted with the vertical portion of each of the fixed contacts, leading to mounting of the spring-equipped lever on the upper casing. The upper casing thus mounted with the spring-equipped lever is fitted in the fit recess of the lower casing, to thereby assemble the spring-equipped lever, upper casing and lower casing together.

In a preferred embodiment of the present invention, the pivot shaft inserting hole is formed at a center of a circular section formed integrally formed at the rear end of the lever member and the recess of the lever member is formed at the circular section so as to be arranged about the pivot shaft inserting hole and rearwardly open. The contacts each are defined at a distal end of each of both lateral leg portions of the U-shaped spring acting as a movable contact spring, wherein the lateral leg portions of the U-shaped spring each inwardly branch at a part thereof, to thereby provide an engagement. The recess of the lever member is open at an opening defined at a rear end of the circular section so as to provide a holding section with which the engagements of the U-shaped spring are engaged. The U-shaped spring is fitted in the recess of the lever member while engaging the engagements with the holding section of the lever member, resulting in being prevented from falling off from the recess. Fitting of the U-shaped spring in the recess of the lever member is carried out while outwardly projecting the contacts from the opening. The contacts are arranged so as to outwardly project from the opening. The front section of the upper casing is formed at a front end thereof with an opening. The top plate is provided at a central portion thereof with projections for engagement and includes lateral side plates each provided on an outer surface thereof with a small projection. The lateral side plates of the lower casing each are formed with a slit for engagement. The lateral side plates of the lower casing each are formed at an upper end thereof with a recess for engagement and on an outer surface thereof with a pawl for engagement in a manner to downwardly project therefrom. The positioning projections of the bottom plate are arranged in a manner to be positioned forwardly and rearwardly on a center line thereof. The spring-equipped lever is mounted on the upper casing in such a manner that the contacts of the U-shaped spring each are pressedly contacted with the vertical portion of each of the fixed contacts, to thereby permit the fixed contacts to equally exhibit pressing force and elastic force with respect to the contacts, respectively, resulting in the lever member being held on a center line of the upper casing and returned to the center line by pivotal movement after it is laterally pivotally moved about the pivot shaft by external force. The upper casing is fitted in the fit recess of the lower casing in a manner to engagedly fit the engagement projection and small projection of the upper casing in the engagement recess and engagement slit of the lower casing.

In a preferred embodiment of the present invention, the lever member is formed into a predetermined length. The pivot shaft inserting hole is formed at a center of a circular section formed integrally formed at the rear end of the lever member. The recess of the lever member is formed at the circular section so as to be arranged about the pivot shaft inserting hole and rearwardly open at an opening defined at a rear end of the circular section so that a holding section with which the engagements of the U-shaped spring are engaged is provided by lateral edges of the opening. The U-shaped spring is formed by bending an elongate spring material of a reduced width into a U-shape. The contacts each are defined at a distal end of each of both lateral leg portions of the U-shaped spring acting as a movable contact spring, wherein the lateral leg portions of the U-shaped spring each inwardly branch at a part thereof, to thereby provide an engagement. The U-shaped spring is fitted in the recess of the lever member while engaging the engagements with the holding section of the lever member, resulting in being prevented from falling off from the recess. Fitting of the U-shaped spring in the recess of the lever member is carried out while outwardly projecting the contacts from the opening.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a two-way switch according to the present invention will be described hereinafter with reference to the accompanying drawings.

Figure 1B:
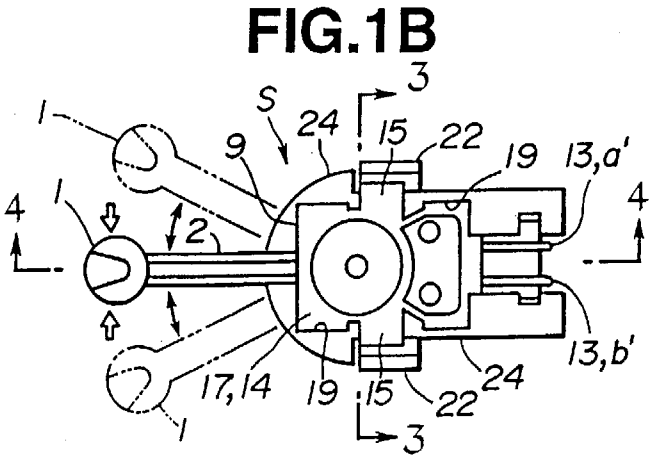
FIG. 1B is a plan view of the two-way lever switch shown in FIG. 1A.
Figure 1A:
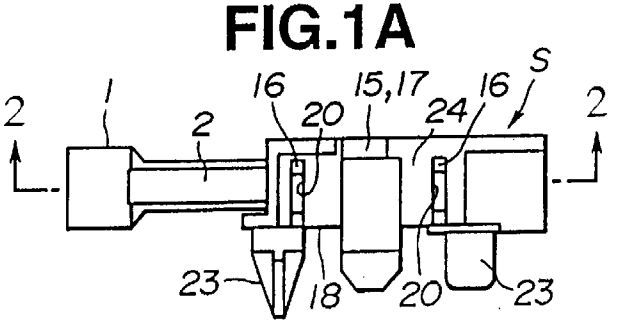
FIG. 1A is a front elevation view showing an embodiment of a two-way lever switch according to the present invention.
Figure 1C:
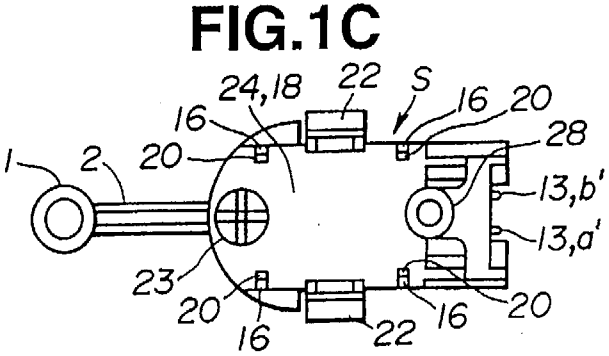
FIG. 1C is a bottom view of the two-way lever switch shown in FIG. 1A.
Figure 1D:
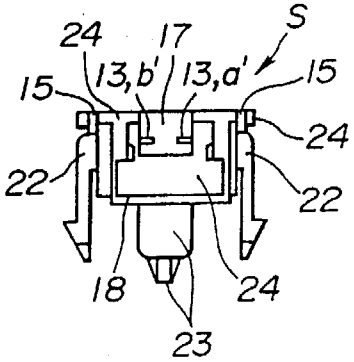
FIG. 1D is a right-side elevation view of the two-way lever switch shown in FIG. 1A.
Figure 1E:
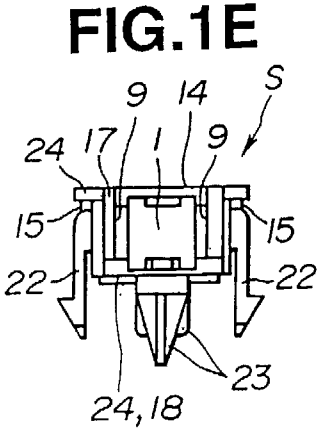
FIG. 1E is a left-side elevation view of the two-way lever switch shown in FIG. 1A.
Figure 2:
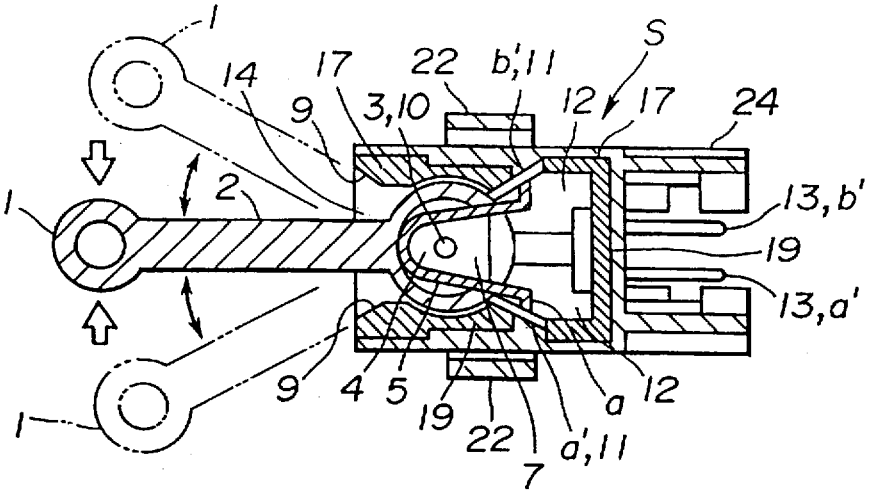
FIG. 2 is a sectional view taken along line 2—2 of FIG. 1A.
Figure 3:
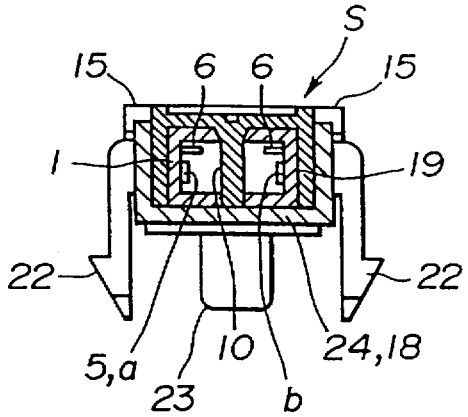
FIG. 3 is a sectional view taken along line 3—3 of FIG. 1B.
Figure 4:
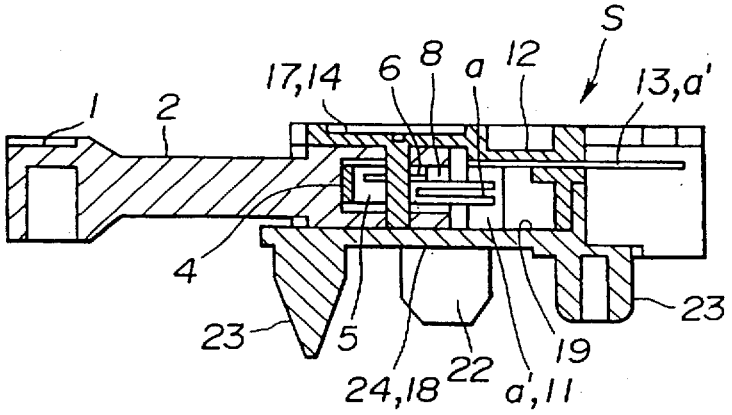
FIG. 4 is a sectional view taken along line 4—4 of FIG. 1B.
Figure 5B:
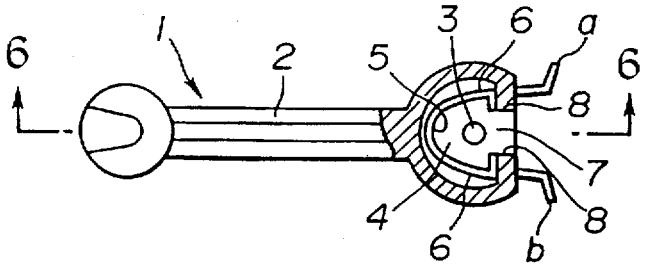
FIG. 5B is a plan view partly in section of the spring-equipped lever shown in FIG. 5A.
Figure 5A:
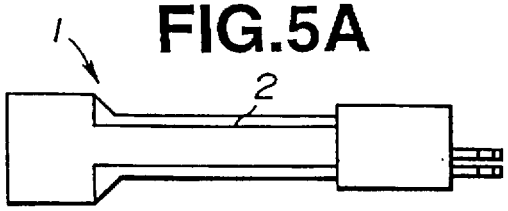
FIG. 5A is a front elevation view showing a spring-equipped lever incorporated in the lever switch of FIG. 1A.
Figure 5C:
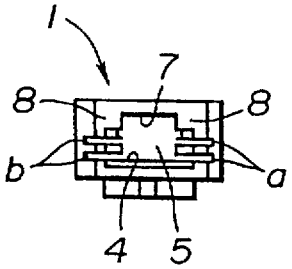
FIG. 5C is a right-side elevation view of the spring-equipped lever shown in FIG. 5A.
Figure 6:
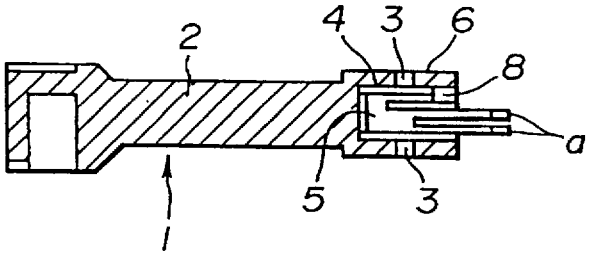
FIG. 6 is a sectional view taken along line 6—6 of FIG. 5B.
Figure 7B:
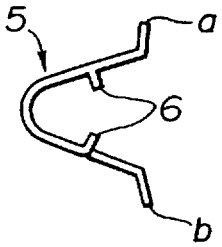
FIG. 7B is a plan view of the U-shaped spring shown in FIG. 7A.
Figure 7A:
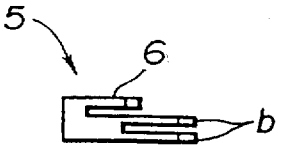
FIG. 7A is a front elevation view showing a U-shaped spring incorporated in the two-way lever switch of FIG. 1A.
Figure 7C:
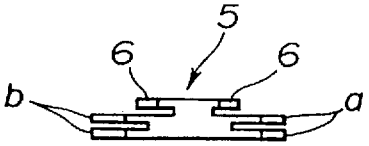
FIG. 7C is a right-side elevation view of the U-shaped spring shown in FIG. 7A.
Figure 8B:
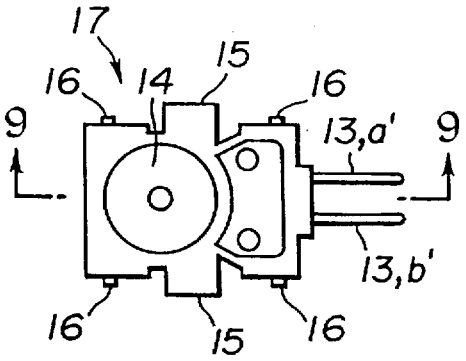
FIG. 8B is a plan view of the upper casing shown in FIG. 8A.
Figure 8A:
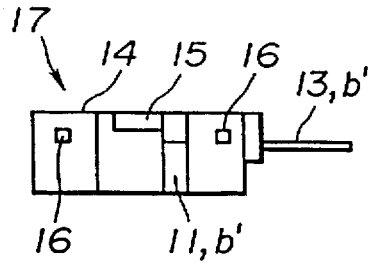
FIG. 8A is a front elevation view showing an upper casing constituting a part of the switch of FIG. 1A.
Figure 8D:
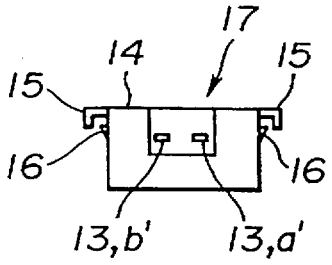
FIG. 8D is a right-side elevation view of the upper casing shown in FIG. 8A.
Figure 8C:
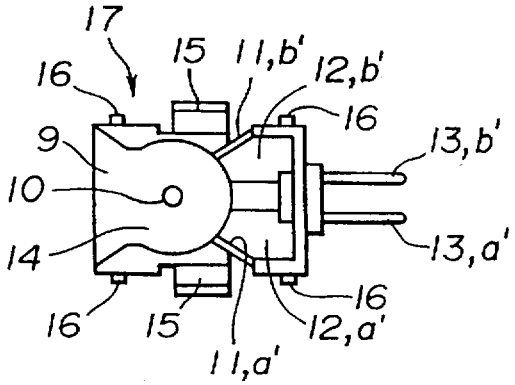
FIG. 8C is a bottom view of the upper casing shown in FIG. 8A.
Figure 9:
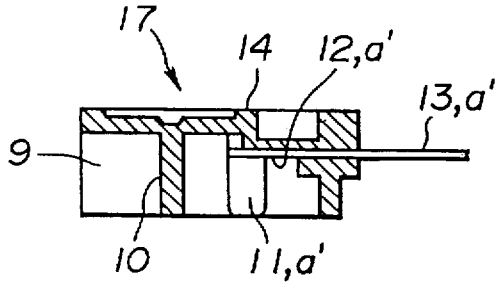
FIG. 9 is a sectional view taken along line 9—9 of FIG. 8B.
Figure 11:
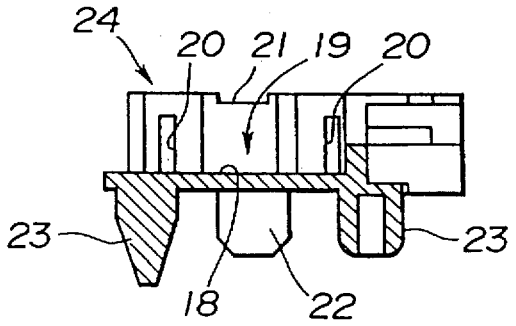
FIG. 11 is a sectional view taken along line 11—11 of FIG. 10B.
Figure 10B:
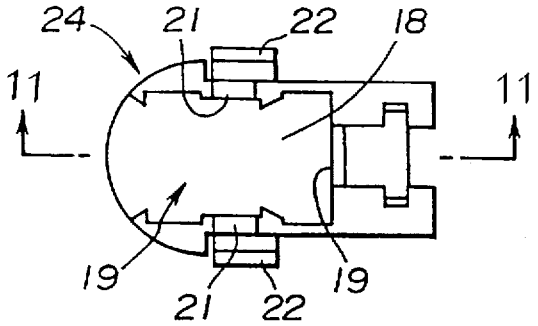
FIG. 10B is a plan view of the lower casing shown in FIG. 10A.
Figure 10E:
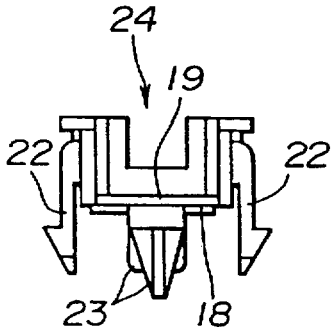
FIG. 10E is a left-side elevation view of the lower casing shown in FIG. 10A.
Figure 10A:
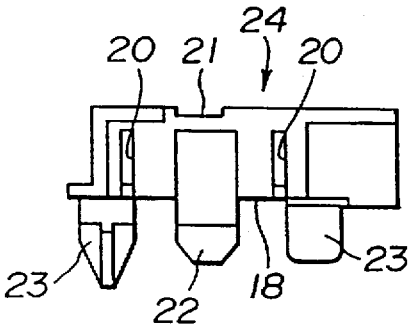
FIG. 10A is a front elevation view showing a lower casing constituting a part of the switch of FIG. 1A.
Figure 10D:
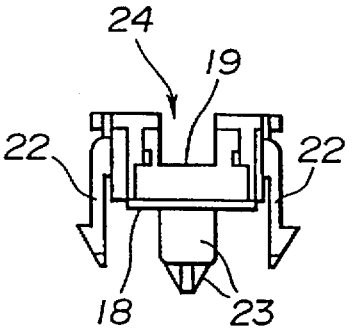
FIG. 10D is a right-side elevation view of the lower casing shown in FIG. 10A.
Figure 10C:
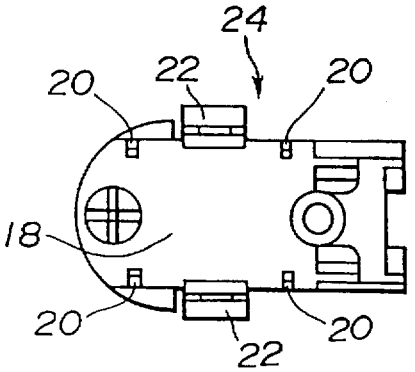
FIG. 10C is a bottom view of the lower casing shown in FIG. 10A.

Referring to FIGS. 1A to 4, an embodiment of a two-way ever switch according to the present invention is illustrated. A two-way lever switch of the illustrated embodiment includes a spring-equipped lever 1. The spring-equipped lever 1 includes a lever member 2, which is integrally provided at a rear end thereof with a circular section. The circular section is formed at a central portion thereof with a pivot shaft inserting hole 3. Also, the circular section is formed with a recess 4, which is arranged about the pivot shaft inserting hole 3 and in a manner to rearwardly open. The spring-equipped lever 1 also includes a spring 5 formed into a U-shape so as to serve as a movable contact spring. The U-shaped spring 5 has contacts a and b defined at distal ends of both lateral leg portions thereof. The lateral leg portions of the U-shaped spring 5 each inwardly branch at a part thereof, to thereby provide an engagement 6.

The recess 4 of the circular section of the lever member 2, as described above, is rearwardly open. More specifically, the recess 4 is open at an opening 7 defined at a rear end of the circular section so as to provide a holding section 8 with which the engagements 6 of the U-shaped spring 5 are engaged. The holding section is defined by edges of the opening 7. Then, the U-shaped spring 5 constructed as described is fitted in the recess 4 of the lever member 2 while engaging the engagements 6 of the lateral leg portions of the U-shaped spring 5 with the holding section 8 of the lever member 2, resulting in being prevented from falling off from the recess 4. Also, fitting of the U-shaped spring 5 in the recess 4 of the lever member 2 is carried out while outwardly projecting the contacts a and b from the opening 7.

The two-way lever switch of the illustrated embodiment also includes an upper casing 17 including a top plate 14 and lateral side plates and comprising a front section and a rear section. The front section is formed at a front end thereof with an opening 9 and includes a front portion of the top plate 14 which is provided at a center of a lower surface thereof with a pivot shaft 10 so as to downwardly extend therefrom. The rear section of the upper casting 17 includes a rear portion of the top plate 14 and is formed therein with fixed contacts a' and b'. The fixed contacts a' and b' each include a vertical portion 11 arranged on each of lateral side surfaces of the rear portion of the top plate 14 and a horizontal portion 12 arranged on each of both sides of a lower surface of the rear portion of the top plate 14 so as to extend from or be contiguous to the vertical portion. The fixed contacts a' and b' each have a terminal 13 defined at a distal end thereof, which is arranged so as to rearwardly outwardly project from the top plate 14. The top plate 14 is provided at a central portion thereof with projections 15 for engagement and each of the lateral side plates of the top plate 14 is provided on an outer surface thereof with a small projection 16.

Further, the two-way lever switch includes a lower casing 24 including a bottom plate 18 and lateral side plates. The bottom plate 18 is provided on an upper surface thereof with a fit recess 19, which is formed into a shape which conforms to an outer configuration of the upper casing 17 or permits the upper casing 17 to be engagedly fitted in the lower casing 24. The lateral side plates each are formed with a slit 20 for engagement. Also, the lateral side plates 20 each are also formed at an upper end thereof with a recess 21 for engagement, as well as on an outer surface thereof with a pawl 22 for engagement in a manner to downwardly project therefrom. The engagement pawl 22 is formed so as to exhibit elasticity, resulting in serving as a pawl-equipped spring element. Further, the bottom plate 18 is provided on a lower surface thereof with front and rear positioning projections 23 in a manner to be positioned on a center line thereof.

In the two-way lever switch of the illustrated embodiment constructed as described above, the pivot shaft 10 of the upper casing 17 is inserted into the pivot shaft inserting hole 3 of the spring-equipped lever 1, to thereby cause the lever member 2 to be forwardly projected at a distal end thereof from the opening 9 of the upper casing 17, resulting in the lever member 2 being pivotally moved within an angular range defined by the opening 9. Also, this results in each of the contacts a and b of the U-shaped spring 5 being pressedly contacted with the vertical portion 11 of each of the fixed contacts a' and b', to thereby permit the fixed contacts a' and b' to equally exhibit pressing force and elastic force with respect to the contacts a and b, respectively, so that the lever member 2 may be held on a center line of the upper casing 17 and returned to the center line by pivotal movement after it is laterally pivotally moved about the pivot shaft 10 by external force. Thus, the spring-equipped lever 1 is mounted in the upper casing 17.

Then, the upper casing 17 in which the spring-equipped lever 1 is thus mounted is fitted in the fit recess 19 of the lower casing 24, resulting in the engagement projection 15 and small projection 16 of the upper casing 17 being engagedly fitted in the engagement recess 21 and engagement slit 20 of the lower casing 24, respectively, so that the upper casing 17 and lower casing 24 are integrally connected to each other.

Thus, the spring-equipped lever 1, upper casing 17 and lower casing 24 are assembled together to provide the two-way lever switch S of the illustrated embodiment.

Now, the spring-equipped lever 1 will be more detailedly described hereinafter.

The lever member 2, as described above, is integrally provided at the rear end thereof with the circular section. The circular section is formed at the central portion thereof with the pivot shaft inserting hole 3. Also, the circular section is formed with the recess 4, which is arranged about the pivot shaft inserting hole 5 and in a manner to be rearwardly open. More specifically, the recess 4 is open at the opening 7 defined at the rear end of the circular section, so that the holding section 8 with which the engagements 6 of the U-shaped spring 5 are engaged is provided by the edges of the opening 7. The lever member 2 thus constructed is formed into a predetermined length.

The U-shaped spring 5 is formed by bending an elongate spring material of a reduced width into a U-shape. The contacts a and b are defined at the distal ends of both lateral leg portions of the thus-formed U-shaped spring 5. Then, the U-shaped spring 5 is fitted in the recess 4 of the lever member 2 while engaging the engagements 6 with the holding section 8 of the lever member 2, resulting in being prevented from falling off from the recess 4 and therefore the lever member 2. Also, fitting of the U-shaped spring 5 in the recess 4 of the lever member 2 is carried out while outwardly projecting the contacts a and b from the opening Y.

Now, the manner of operation of the two-way lever switch of the illustrated embodiment constructed as described above will be described hereinafter.

When an object such as a CD or the like is charged in an object operating equipment such as a CD player or the like in which the two-way lever switch of the illustrated embodiment is incorporated, the object is abutted against the distal end of the spring-equipped lever 1 to cause external force to be applied to the distal end of the lever 1 in either right or left direction. This results in the spring-equipped lever 1 being pivotally moved about the pivot shaft 10 within an angular range defined by the opening Y in the right or left direction, so that one of the contacts a and b of the U-shaped spring 5 pressedly contacted with the fixed contacts a' and b' is separated from the fixed contact corresponding thereto and the other contact is deflected against elastic force, to thereby be more pressedly contacted with the remaining fixed contact.

When external force is applied to the two-way lever switch, for example, from the right direction, to thereby cause the spring-equipped lever 1 to be rotated in the right direction, the contact a of the contacts a and b which are pressedly contacted with the fixed contacts a' and b', leading to switching-on is separated from the fixed contacted a', leading to switching-off, whereas the contact b is more pressedly contacted with the fixed contact b'.

On the contrary, when external force is applied to the two-way lever switch from the left direction, to cause the spring-equipped lever 1 to be rotated in the left direction, the contact b of the contacts a and b pressedly contacted with the fixed contact a' and b', leading to switching-on is separated from the fixed contact b', leading to switching-off and the contact a is more pressedly contacted with the fixed contact a'

Thus, it will be noted that the two-way lever switch of the illustrated embodiment carries out fully equal switching operation irrespective of any direction in which external force is applied to the spring-equipped lever 1.

In the two-way lever switch of the illustrated embodiment, the spring-equipped lever 1 which bas been rotated in either right or left direction due to application of external force thereto is returned to the central position by elastic force of the left-hand or right-hand lateral leg portion of the U-shaped spring with which the lever 1 is pressedly contacted, immediately after the the lever 1 is released from the external force.

As can be seen from the foregoing, the two-way lever switch of the present invention includes the spring-equipped lever in which the U-shaped spring is to be fitted in the lever member, the upper casing in which the spring-equipped lever is mounted, and the lower casing in which the upper casing is to be fitted; wherein the three components or the spring-equipped lever, upper casing and lower casing are assembled together in turn without using any fastening means such as screws or the like. Such construction permits the two-way lever switch to be highly readily and rapidly assembled. Also, the three components are manufactured with high accuracy and high durability and at a reduced cost, so that the two-way lever switch assembled may be significantly improved in accuracy, durability and cost.

Also, the two-way lever switch of the present invention accomplishes fully equal switching operation irrespective of either left or right direction in which external force is applied to the distal end of the spring-equipped lever, resulting in being optimum for such a purpose.

Further, the two-way lever switch of the present invention is so constructed that elastic force of the U-shaped spring normally keeps the contacts constantly pressedly contacted with the fixed contacts, leading to switching-on. Thus, the two-way switch of the present invention is normally kept at a highly stable switching-on state without causing generation of chattering due to vibration or the like, resulting in exhibiting highly stable normal-closed state.

Moreover, in the present invention, rotation of the spring-equipped lever due to application of external force thereto permits separation or release of one of the contacts from the fixed contact corresponding thereto to be rapidly and positively carried out, leading to switching-off and pressed contact of the other contact with the fixed contact corresponding thereto to be more firmly accomplished, to thereby ensure a satisfactory switching action.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A two-way lever switch comprising:

a spring-equipped lever including a lever member and a U-shaped spring;

said lever member being formed at a rear end thereof with a pivot shaft inserting hole;

said lever member being formed at the rear end thereof with a recess in a manner to be arranged about said pivot pin inserting hole;

said U-shaped spring having contacts defined at both distal ends thereof;

said U-shaped spring being fitted in said recess of said lever member while rearwardly projecting said contacts from said recess of said lever member;

an upper casing including a top plate and divided into a front section and a lower section;

said front section including a front portion of said top plate which is provided at a center of a lower surface thereof with a pivot shaft;

said rear section including a rear portion of said top plate and being formed therein with fixed contacts;

said fixed contacts each including a vertical portion arranged on each of lateral side surfaces of said rear section of said top plate and a horizontal portion arranged on each of both sides of a lower surface of said rear portion of said top plate so as to be contiguous to said vertical portion and having a terminal defined at a distal end thereof so as to rearwardly outwardly project from said top plate; and a lower casing including a bottom plate and lateral side plates;

said bottom plate being provided on an upper surface thereof with a fit recess which is formed into a shape conforming to an outer configuration of said upper casing;

said lateral side plates each being formed on an outer surface thereof with a pawl-equipped spring element for mounting the lever switch;

said bottom plate being provided on a lower surface thereof with positioning projections;

said pivot shaft of said upper casing being inserted into said pivot shaft inserting hole of said spring-equipped lever, to thereby cause said lever member to be forwardly projected at a distal end thereof from said opening of said upper casing, resulting in said lever member being pivotally moved within a range defined by said opening and each of said contacts of said U-shaped spring being pressedly contacted with said vertical portion of each of said fixed contacts, leading to mounting of said spring-equipped lever on said upper casing;

said upper casing thus mounted with said spring-equipped lever being fitted in said fit recess of said lower casing, to thereby assemble said spring-equipped lever, upper casing and lower casing together;

wherein said lever member is movable within a predetermined movable range and is biased by said U-shaped spring such that said lever member being in an intermediate position of said movable range when no external force is provided thereto, said two-way lever switch being in an ON state when said lever member is in said intermediate position, while said two-way switch being in an OFF state when said lever member being positioned to either end of said movable range by an external force.

2. A two-way lever switch as defined in claim 1, wherein said pivot shaft inserting hole is formed at a center of a circular section formed integrally formed at said rear end of said lever member;

said recess of said lever member is formed at said circular section so as to be arranged about said pivot shaft inserting hole and rearwardly open;

said contacts each are defined at a distal end of each of both lateral leg portions of said U-shaped spring acting as a movable contact spring, said lateral leg portions of said U-shaped spring each inwardly branching at a part thereof, to thereby provide an engagement;

said recess of said lever member is open at an opening defined at a rear end of said circular section so as to provide a holding section with which said engagements of said U-shaped spring are engaged;

said U-shaped spring is fitted in said recess of said lever member while engaging said engagements with said holding section of said lever member, resulting in being prevented from falling off from said recess, fitting of said U-shaped spring in said recess of said lever member being carried out while outwardly projecting said contacts from said opening;

said contacts are arranged so as to outwardly project from said opening;

said front section of said upper casing is formed at a front end thereof with an opening;

said top plate is provided at a central portion thereof with projections for engagement and includes lateral side plates each provided on an outer surface thereof with a small projection;

said lateral side plates of said lower casing each are formed with a slit for engagement;

said lateral side plates of said lower casing each are formed at an upper end thereof with a recess for engagement and on an outer surface thereof with a pawl for engagement in a manner to downwardly project therefrom;

said positioning projections of said bottom plate are arranged in a manner to be positioned forwardly and rearwardly on a center line thereof;

said spring-equipped lever is mounted on said upper casing in such a manner that said contacts of said U-shaped spring each are pressedly contacted with said vertical portion of each of said fixed contacts, to thereby permit said fixed contacts to equally exhibit pressing force and elastic force with respect to said contacts, respectively, resulting in said lever member being held on a center line of said upper casing and returned to the center line by pivotal movement after it is laterally pivotally moved about said pivot shaft by external force; and said upper casing is fitted in said fit recess of said lower casing in a manner to engagedly fit said engagement projection and small projection of said upper casing in said engagement recess and engagement slit of said lower casing.

3. A two-way lever switch as defined in claim 1, wherein said lever member is formed into a predetermined length;

said pivot shaft inserting hole is formed at a center of a circular section formed integrally formed at said rear end of said lever member;

said recess of said lever member is formed at said circular section so as to be arranged about said pivot shaft inserting hole and rearwardly open at an opening defined at a rear end of said circular section so that a holding section with which said engagements of said U-shaped spring are engaged is provided by edges of said opening;

said U-shaped spring is formed by bending an elongate spring material of a reduced width into a U-shape;

said contacts each are defined at a distal end of each of both lateral leg portions of said U-shaped spring acting as a movable contact spring, said lateral leg portions of said U-shaped spring each inwardly branching at a part thereof, to thereby provide an engagement;

said U-shaped spring is fitted in said recess of said lever member while engaging said engagements with said holding section of said lever member, resulting in being prevented from falling off from said recess, and fitting of said U-shaped spring in said recess of said lever member is carried out while outwardly projecting said contacts from said opening.

4. A two-way lever switch, comprising:

a lever member having a pivot shaft inserting hole and a recess at a rear end thereof, said lever member being connected to a switch housing by a pivot pin inserted through said pivot shaft inserting hole, said lever member being movable within a predetermined movable range;

a U-shaped spring fitted in said recess of said lever member and having a pair of end contacts at both ends thereof, said end contacts projecting from said recess of said lever member, and said U-shaped spring biasing said lever member such that said lever member being set to an intermediate position of said movable range when no external force being applied to said lever member;

a pair of fixed contacts provided on an internal surface of said switch housing, each of said fixed contacts contacting corresponding one of said end contacts of said U-shaped spring when said lever member being positioned at said intermediate position of said movable range;

wherein only one of said fixed contacts contacting said corresponding one of said end contacts when said lever member being positioned at either end position of said movable range by an external force.

5. A two-way lever switch as defined in claim 4, wherein said lever member is automatically returned to said intermediate position when said external force is removed from said lever member.

6. A two-way lever switch as defined in claim 4, wherein said two-way lever switch is in an ON state when said lever member is set to said intermediate position of said movable range wherein said fixed contacts are electrically connected each other through said end contacts of said U-shaped spring, and said two-way lever switch is in an OFF state when said lever member is set to either one of end positions of said movable range wherein said fixed contacts are electrically disconnected from one another.

* * * * *

UNITED STATES PATENT AND TRADEMARK OFFICE

CERTIFICATE OF CORRECTION

PATENT NO. : 5,742,013

DATED : April 21, 1998

INVENTOR(S) : Myojin et al.

It is certified that error appears in the above-identified patent and that said Letters Patent is hereby corrected as shown below:

On the title page, change item [73] assignee to read as follows
--MITSUKI DENSHI KOGYO
KABUSHIKI KAISHA--.

Signed and Sealed this

Third Day of November, 1998

*Attest:*

*Attesting Officer*

BRUCE LEHMAN

*Commissioner of Patents and Trademarks*

UNITED STATES PATENT AND TRADEMARK OFFICE
CERTIFICATE OF CORRECTION

PATENT NO. : 5,742,013

DATED : April 21 1998

INVENTOR(S) : Satoshi Myojin, et al.

It is certified that error appears in the above-identified patent and that said Letters Patent is hereby corrected as shown below:

On the title page: Item [73] Assignee to read as follows:

--Mitsuku Denshi Kogyo Kabushiki Kaisha, Tokyo Japan--.

This certificate supersedes Certificate of Correction issued November 3, 1998.

Signed and Sealed this

Seventh Day of September, 1999

*Attest:*

Q. TODD DICKINSON

*Attesting Officer*

*Acting Commissioner of Patents and Trademarks*